US008254583B2

(12) United States Patent
Kim

(10) Patent No.: US 8,254,583 B2
(45) Date of Patent: Aug. 28, 2012

(54) METHOD AND APPARATUS TO REPRODUCE STEREO SOUND OF TWO CHANNELS BASED ON INDIVIDUAL AUDITORY PROPERTIES

(75) Inventor: Sun-min Kim, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1161 days.

(21) Appl. No.: 11/758,138

(22) Filed: Jun. 5, 2007

(65) Prior Publication Data

US 2008/0159544 A1 Jul. 3, 2008

(30) Foreign Application Priority Data

Dec. 27, 2006 (KR) ..... 10-2006-0134983

(51) Int. Cl.
*H04R 5/00* (2006.01)

(52) U.S. Cl. ..... 381/1; 381/310

(58) Field of Classification Search ..... 381/303, 381/17, 1, 309, 310
See application file for complete search history.

(56) References Cited

U.S. PATENT DOCUMENTS

| | | | | |
|---|---|---|---|---|
| 5,729,612 | A * | 3/1998 | Abel et al. | 381/56 |
| 5,751,815 | A * | 5/1998 | Philp et al. | 381/17 |
| 5,910,990 | A * | 6/1999 | Jang | 381/1 |
| 6,009,178 | A * | 12/1999 | Abel et al. | 381/1 |
| 6,118,875 | A * | 9/2000 | M.o slashed.ller et al. | 381/1 |
| 6,243,476 | B1 * | 6/2001 | Gardner | 381/303 |
| 6,363,155 | B1 * | 3/2002 | Horbach | 381/17 |
| 6,741,706 | B1 * | 5/2004 | McGrath et al. | 381/22 |
| 7,532,943 | B2 * | 5/2009 | Weare | 700/94 |
| 7,664,272 | B2 * | 2/2010 | Terai et al. | 381/17 |
| 7,720,229 | B2 * | 5/2010 | Duraiswami et al. | 381/17 |
| 2001/0008996 | A1 * | 7/2001 | Choi | 704/500 |
| 2004/0013278 | A1 * | 1/2004 | Yamada | 381/309 |
| 2005/0129249 | A1 | 6/2005 | Chabanne | |
| 2006/0062410 | A1 * | 3/2006 | Kim et al. | 381/310 |
| 2008/0057938 | A1 * | 3/2008 | Dunko | 455/425 |

FOREIGN PATENT DOCUMENTS

| | | |
|---|---|---|
| CN | 1605226 | 4/2005 |
| JP | 2000-295698 | 10/2000 |
| KR | 2001-57764 | 7/2001 |
| KR | 2002-80730 | 10/2002 |
| KR | 1020070033860 | 3/2007 |
| WO | 99/49574 | 9/1999 |

OTHER PUBLICATIONS

Chinese Office Action issued Jul. 10, 2009 in CN Application No. 2007101382268.
Chinese Office Action issued Dec. 5, 2011 in CN Patent Application No. 200710138226.8.

* cited by examiner

*Primary Examiner* — Vivian Chin
*Assistant Examiner* — Friedrich W Fahnert
(74) *Attorney, Agent, or Firm* — Stanzione & Kim, LLP

(57) ABSTRACT

A method and apparatus to reproduce stereo sound, which generates optimal stereo sound designed for individual auditory properties. The method includes generating a one or more virtual surround filters corresponding to each of a plurality of head-related transfer functions (HRTFs) classified according to one or more individual auditory properties, generating stereo sound for the one or more virtual surround filters, and selecting at least one from the one or more virtual surround filters, and reproducing the stereo sound based on a filter value of the selected at least one virtual surround filter.

23 Claims, 5 Drawing Sheets

METHOD AND APPARATUS TO REPRODUCE STEREO SOUND OF TWO CHANNELS BASED ON INDIVIDUAL AUDITORY PROPERTIES

CROSS-REFERENCE TO RELATED APPLICATIONS

This application claims priority under 35 U.S.C. §119(a) from Korean Patent Application No. 10-2006-0134983, filed on Dec. 27, 2006, in the Korean Intellectual Property Office, the disclosure of which is incorporated herein in its entirety by reference.

BACKGROUND OF THE INVENTION

1. Field of the Invention

The present general inventive concept relates to a stereo sound reproduction system, and more particularly, to a method and apparatus to reproduce stereo sound, which generates optimal stereo sound designed for individual auditory properties.

2. Description of the Related Art

In general, a virtual sound generation system provides a surround sound effect such as a 5.1 channel system, using only two speakers.

Technology related to this virtual sound generation is disclosed in WO 99/49574 (PCT/AU 99/00002, filed on 6 Jan. 1999, entitled, "Audio Signal Processing Method and Apparatus").

In a conventional virtual sound generation system, a multi-channel audio signal is down-mixed as a 2-channel audio signal using a head-related transfer function (HRTF).

Referring to FIG. 1, a 5.1-channel audio signal is input. A5.1-channel system includes a left front channel, a right front channel, a center front channel, a left surround channel, a right surround channel, and a low frequency effect (LFE) channel. Left and right impulse response functions are applied to the respective channels. Thus, a corresponding left front impulse response function 4 is convolved with a left front signal 3 with respect to a left front channel 2 in an adder 6. The left front impulse response function 4 uses an HRTF as an impulse response to be received by a left ear of a listener. An output signal 7 is combined with a left channel signal 10 to be used by a headphone. Similarly, a corresponding impulse response function 5 with respect to a right ear for a right channel speaker is convolved with a left front signal 3 in an adder 8 so as to generate an output signal 9 to be combined with a right channel signal 11. Thus, the arrangement of FIG. 1 requires about 12 convolution steps with respect to 5.1-channel signals. As such, the 5.1-channel signals are down-mixed by combining measured HRTFs. Even though the 5.1-channel signals are reproduced as 2-channel signals, a surround effect as reproduced by a multi-channel system can be obtained.

Meanwhile, the conventional virtual sound generation system does not reflect individual auditory characteristics but uses the HRTF that standardizes human auditory properties such as by using a dummy head. However, since human spatial perception of a sound source depends on each individual, the conventional virtual sound generation system that uses the standardized HRTF fails to produce the best stereo sound performance.

SUMMARY OF THE INVENTION

The present general inventive concept provides a method and apparatus to reproduce stereo sound, which generates optimal stereo sound designed for individual auditory properties.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a method of stereo sound reproducing method including generating one or more virtual surround filters corresponding to one or more HRTFs (head-related transfer functions) classified according to one or more individual auditory properties, generating stereo sound for the one or more virtual surround filters, and selecting at least one from the one or more virtual surround filters, and reproducing the stereo sound based on a filter value of the selected at least one virtual surround filter.

The foregoing and/or other aspects and utilities of the present general inventive concept may also be achieved by providing a stereo sound reproducing apparatus including an auditory properties correction unit to generate stereo sound for one or more virtual surround filters corresponding to each of a plurality of HRTFs classified according to one or more individual auditory properties and to select one from the one or more virtual surround filters, and a stereo sound generator to generate a multi-channel signal as a 2-channel stereo sound based on a filter value of the at least one virtual surround filter selected by the auditory properties correction unit.

The auditory properties correction unit may also include a test signal generator to generate a test signal, a test stereo sound generator to generate the one or more virtual surround filters corresponding to each of the HRTFs classified according to the one or more individual auditory properties, and to convert the test signal into a virtual stereo sound based on the one or more virtual surround filters generated by the test stereo sound generator, and a filter selector to select at least one from the one or more of virtual surround filters based on the virtual stereo sound generated by the test stereo sound generator and to establish the at least one selected virtual surround filter as a user filter.

The foregoing and/or other aspects and utilities of the present general inventive concept may also be achieved by providing an apparatus to reproduce stereo sound by which a multi-channel audio signal is reproduced as a 2-channel output, the apparatus including an auditory properties correction unit to generate one or more virtual surround filters corresponding to each of a plurality of HRTFs classified according to one or more individual auditory properties, to generate stereo sound for the one or more virtual surround filters, and to select at least one from the one or more virtual surround filters, a virtual surround filter unit to convert a 2-channel audio signal into a 2-channel virtual surround audio signal according to the virtual surround filter selected by the auditory properties correction unit, a signal correction filter unit to correct one or more signal characteristics between the 2-channel virtual surround audio signals output by the virtual surround filter unit and other channel audio signals than the 2-channel virtual surround audio signals, and an addition unit to add the channel signals output by the virtual surround filter unit and the signal correction filter unit.

The foregoing and/or other aspects and utilities of the present general inventive concept may also be achieved by providing a computer-readable recording medium having embodied thereon a computer program to execute a method, wherein the method includes generating one or more virtual surround filters corresponding to each of a plurality of HRTFs classified according to one or more individual auditory properties, generating stereo sound for the one or more virtual surround filters, and selecting at least one from the one or more virtual surround filters, and reproducing the stereo sound based on a filter value of the selected at least one virtual surround filter.

The foregoing and/or other aspects and utilities of the present general inventive concept may also be achieved by providing an apparatus to produce stereo sound, the apparatus including a virtual surround filter unit to receive a first multi-channel audio signal, and to generate plurality of surround signals, wherein the plurality of surround signals corresponds with one or more individual auditory properties.

The foregoing and/or other aspects and utilities of the present general inventive concept may also be achieved by providing a method of reproducing stereo sound, the method including generating a plurality of surround signals from a first multi-channel audio signal corresponding to one or more individual auditory properties, generating a plurality of corrected signals from a second multi-channel audio signal, adding one of the plurality of surround signals and one of the plurality of corrected signals to form a left channel signal and adding an other of the plurality of surround signals and an other of the plurality of corrected signals to form a right channel signal.

The foregoing and/or other aspects and utilities of the present general inventive concept may also be achieved by providing a stereo sound reproducing apparatus including an auditory properties correction unit to select at least one virtual surround filter corresponding to one or more individual auditory characteristics and a stereo sound generator to generate a two-channel stereo sound based on a filter value of the at least one virtual surround filter selected by the auditory properties correction unit.

The foregoing and/or other aspects and utilities of the present general inventive concept may also be achieved by providing a stereo sound reproducing system including an auditory properties correction unit to localize a virtual signal source in an elevated direction based on one or more individual auditory properties and a stereo sound generator to generate a multi-channel stereo sound in response to the auditory properties correction unit.

The foregoing and/or other aspects and utilities of the present general inventive concept may also be achieved by providing a stereo sound reproducing apparatus to process a multi channel audio signal, the apparatus including a signal correction filter unit to process a first group of channels of the multi-channel audio signal to generate a first signal and a second signal, a virtual surround filter unit to process a second group of channels of the multi-channel audio signal according to one or more virtual surround filters corresponding to one or more HRTFs and one or more individual auditory properties, to generate a first surround signal and a second surround signal and an addition unit to add the first signal and the first surround signal to generate a first speaker signal, and to add the second signal and the second surround signal to generate a second speaker signal.

The foregoing and/or other aspects and utilities of the present general inventive concept may also be achieved by providing a stereo sound reproducing apparatus to process a multi-channel audio signal, the apparatus including a stereo sound generator having one or more filter units to process surround channels according to one or more filter coefficients corresponding to at least one of individual auditory properties to generate first and second surround signals.

BRIEF DESCRIPTION OF THE DRAWINGS

These and/or other aspects and utilities of the present general inventive concept will become more apparent by describing in detail exemplary embodiments thereof with reference to the attached drawings in which.

DETAILED DESCRIPTION OF THE PREFERRED EMBODIMENTS

Figure 1:
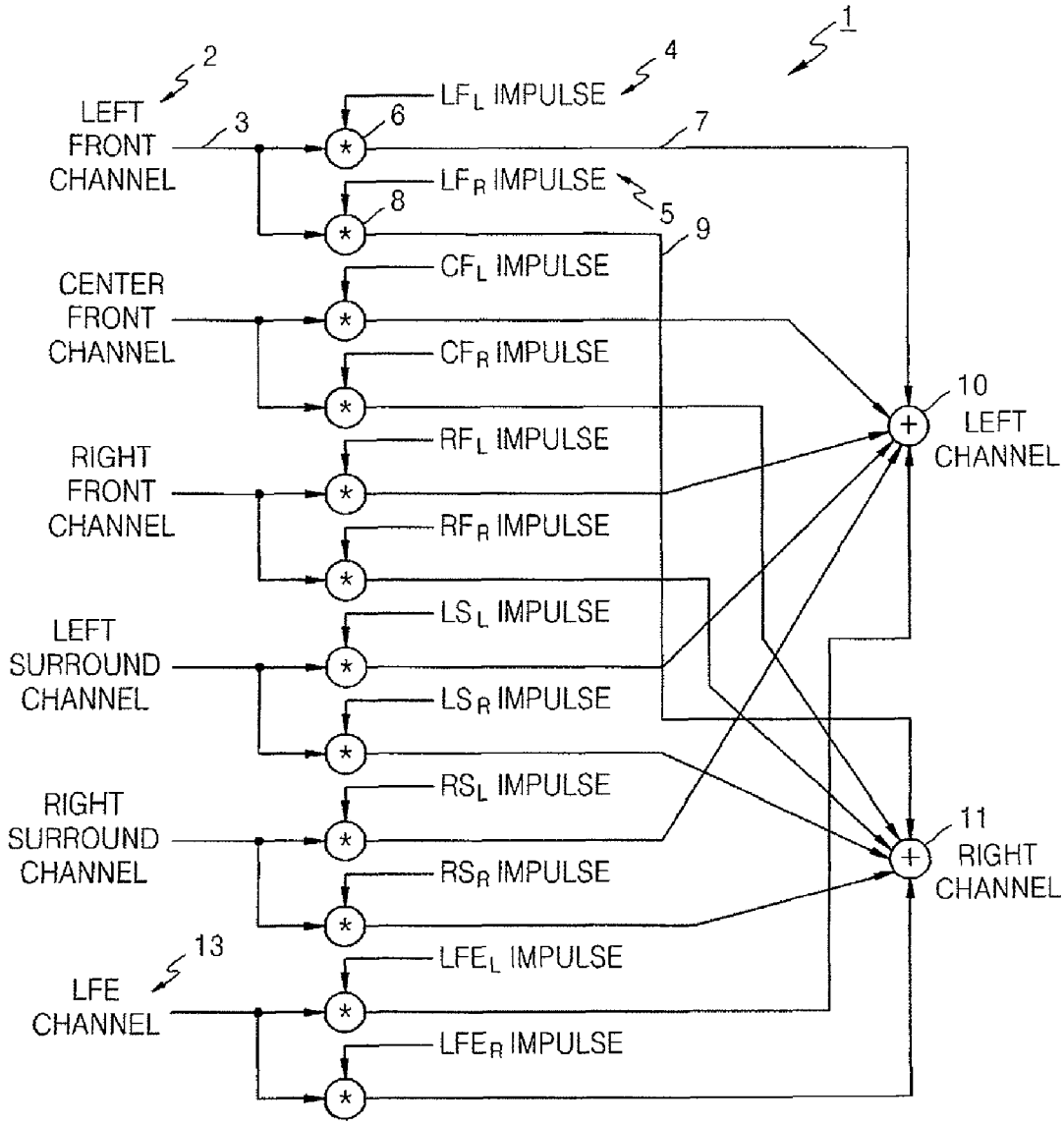
FIG. 1 (PRIOR ART)
FIG. 1 is a block diagram illustrating a conventional stereo sound generation system.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
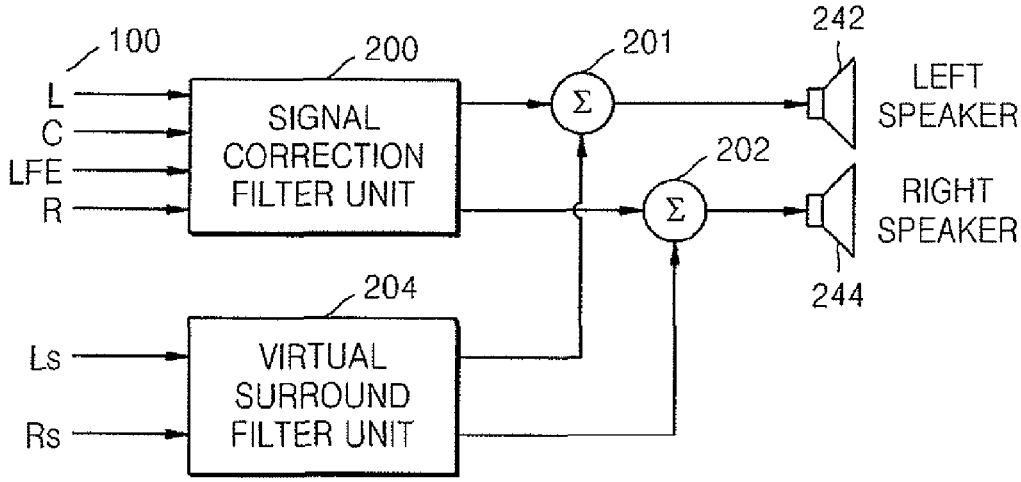
FIG. 2 illustrates a stereo sound generator applied to a stereo sound reproduction apparatus according to an embodiment of the present general inventive concept.

FIG. 2 illustrates a stereo sound generator applied to a stereo sound reproduction apparatus according to an embodiment of the present general inventive concept. Referring to FIG. 2, a multi-channel audio signal 100 includes a left channel signal (L), a center channel signal (C), a low frequency effect channel signal (LFE), a right channel signal (R), a left surround channel signal (Ls), and a right surround channel signal (Rs). In the present embodiment, a 5.1 channel system has been described, but the present general inventive concept can be applied to a multi-channel system such as a 6.1 channel system or a 7.1 channel system.

A virtual surround filter unit 204 receives a left surround channel signal (Ls) and a right surround channel signal (Rs) of multi-channel audio signals.

The virtual surround filter unit 204 lowers a correlation between input left and right surround channel signals, simultaneously generates a presence thereof, applies a head-related transfer function (HRTF) that reflects individual auditory properties to each filter coefficient, and generates a virtual sound source at left and right rear sides of the listener.

A signal correction filter unit 200 receives a left channel signal (L), a center channel signal (C), a low frequency effect channel signal (LFE), and a right channel signal (R).

Accordingly, output gains of the left and right surround channel signals output from the virtual surround filter unit 204 are changed and time delays of the left and right surround channel signals occur. Thus, the signal correction filter unit 200 adjusts gains and time delays of the left channel signal (L), the center channel signal (C), the low frequency effect channel signal (LFE), and the right channel signal (R) according to the output gains and the time delays of the left and right surround channel signals.

First and second addition units 201 and 202 add left channel signals output from the virtual surround filter unit 204 and the signal correction filter unit 200 and add right channel signals output from the virtual surround filter unit 204 and the signal correction filter unit 200, respectively. Then, the added left signal is output to the left channel speaker 242 and the added right signal is output to the right channel speaker 244.

Figure 3A:
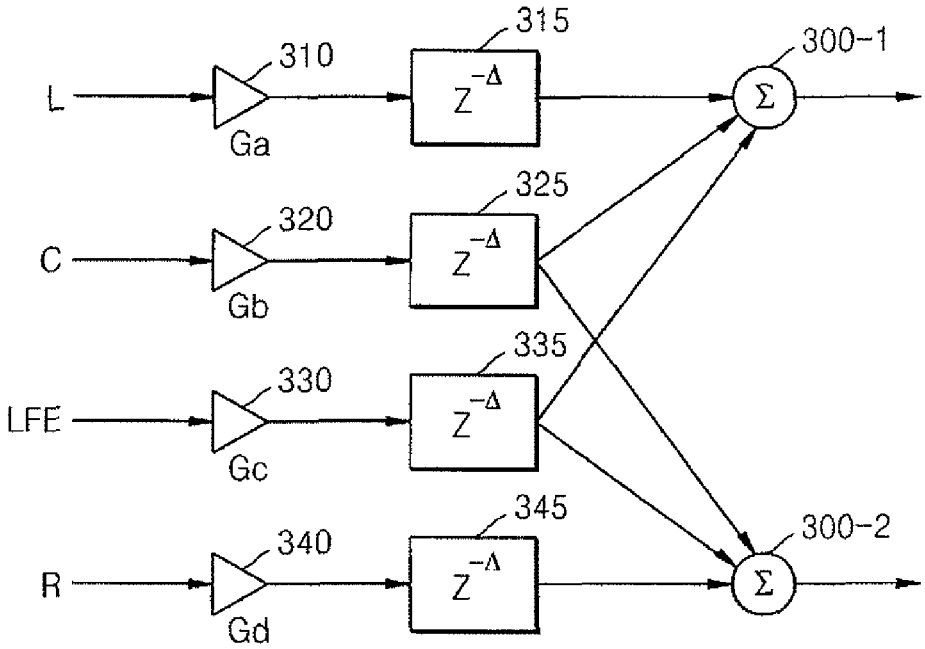
FIG. 3A illustrates a signal correction filter unit illustrated in FIG. 2 according to an embodiment of the present general inventive concept.

FIG. 3A illustrates the signal correction filter unit 200 according to an embodiment of the present general inventive concept. Referring to FIG. 3A, an output gain of the left channel signal (L) is changed by a gain unit 310 and the left channel signal (L) is delayed by a delay unit 315.

An output gain of the center channel signal (C) is changed by a gain unit 320 and the center channel signal (C) is delayed by a delay unit 325.

An output gain of the low frequency effect channel signal (LFE) is changed by a gain unit 330 and the low frequency effect channel signal (LFE) is delayed by a delay unit 335.

An output gain of the right channel signal (R) is changed by a gain unit 340 and the right channel signal (R) is delayed by a delay unit 345.

A first addition unit 300-1 adds signals output from the delay units 315, 325, and 335. A second addition unit 300-2 adds signals output from the delay units 325, 335, and 345.

Figure 3B:
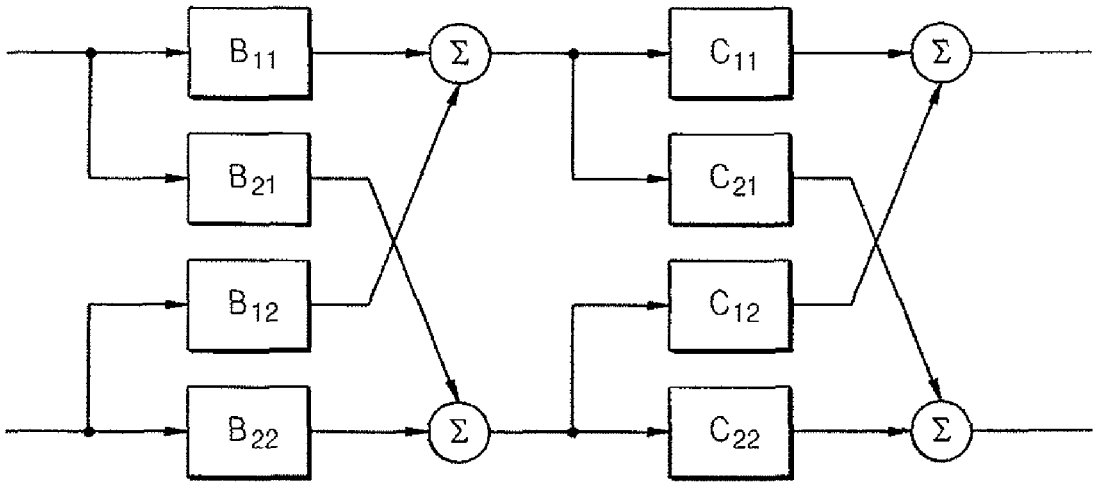
FIG. 3B illustrates a virtual surround filter unit illustrated in FIG. 2 according to an embodiment of the present general inventive concept.

FIG. 3B illustrates the virtual surround filter unit 204 illustrated in FIG. 2 according to an embodiment of the present general inventive concept. Referring to FIG. 3B, the virtual surround filter unit 204 is calculated using binaural synthesis filter units ($B_{11}$, $B_{12}$, $B_{21}$, $B_{22}$) implemented as an HRTF matrix between a virtual sound source and a virtual listener and using cross-talk canceling filter units ($C_{11}$, $C_{12}$, $C_{21}$, $C_{22}$) implemented as an inverse matrix of the HRTF matrix between the virtual listener and two channel output positions.

The binaural synthesis filter units ($B_{11}$, $B_{12}$, $B_{21}$, $B_{22}$) are a filter matrix that localizes a virtual speaker into positions of a left surround speaker and a right surround speaker, and the cross-talk canceling filter units ($C_{11}$, $C_{12}$, $C_{21}$, $C_{22}$) are a filter matrix that cancels cross-talk between two speakers and two ears of a listener. Thus, a matrix K(z) of the virtual surround filter unit 204 is calculated by multiplying the binaural synthesis matrix and the cross-talk canceller matrix.

Figure 4:
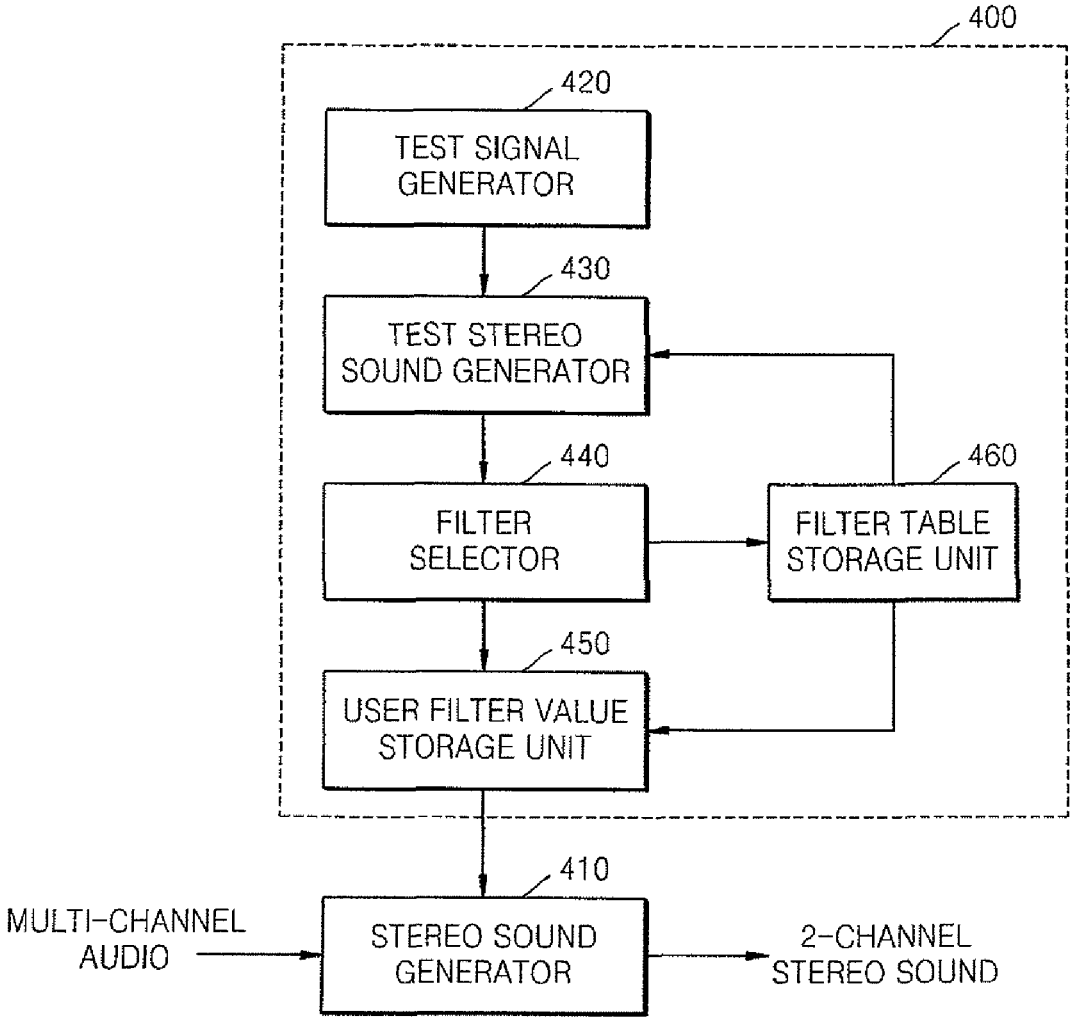
FIG. 4 is a block diagram of a stereo sound reproducing apparatus according to an embodiment of the present general inventive concept.

FIG. 4 is a block diagram of a stereo sound reproducing apparatus according to an embodiment of the present general inventive concept. Referring to FIG. 4, the stereo sound reproducing apparatus comprises an auditory properties corrector 400 and a stereo sound generator 410. The auditory properties corrector 400 includes a test signal generator 420, a test stereo sound generator 430, a filter selector 440, a user filter value storage unit 450, and a filter table storage unit 460.

The auditory properties corrector 400 generates a plurality of virtual surround filters that correspond to each HRTF classified according to individual auditory properties, generates stereo sounds for the plurality of virtual surround filters, selects one of the plurality of virtual surround filters, and establishes the selected virtual surround filter as an optimal user filter value. In an embodiment of the present general inventive concept, the optimal user filter value is set as a correction value of individual auditory properties to correct or be used as coefficients of the stereo sound generator 410.

In another embodiment of the present general inventive concept, the auditory properties corrector 400 generates a plurality of virtual surround filters that correspond to speaker positions, and selects one of the plurality of virtual surround filters.

The auditory properties corrector 400 applies filter coefficients of the optimal user filter value selected by the filter selector 440 to the virtual surround filter unit 204 as filter coefficients of the filters units (B11, B12, B21, B22 and/or C11, C12, C21, C22) illustrated in FIG. 2, to generate a multi-channel signal as a 2-channel stereo sound.

The auditory properties corrector 400 will now be described in detail.

The test signal generator 420 generates a predetermined audio signal that is to be tested.

The filter table storage unit 460 establishes a table of the plurality of virtual surround filters corresponding to each of the HRTFs classified according to individual auditory properties and stores the table. The filter table storage unit 460 can also store various types of filter coefficients according to position information of a speaker, besides the plurality of virtual surround filters reflecting individual auditory properties.

The test stereo sound generator 430, for example, sequentially applies the plurality of virtual surround filters stored in the filter table storage unit 460 to a test signal generated by the test signal generator 420 to generate a stereo sound signal.

The filter selector 440 selects one from among the plurality of virtual surround filters, that is determined to generate the most appropriate stereo sound by a user who listens to the stereo sound signal generated by the test stereo sound generator 430 according to the stereo sound signal.

The user filter value storage unit 450 selects a filter coefficient corresponding to the virtual surround filter selected by the filter selector 440 from the filter coefficients stored in the filter table storage unit 460 and stores the selected filter coefficient as the optimal virtual surround filter value. The optimal virtual surround filter value can be used in the virtual surround filter unit 204 to generate a surround signal to be combined with the channel signal, so that left and right sounds are reproduced from the speakers 242, 244.

Figure 5:
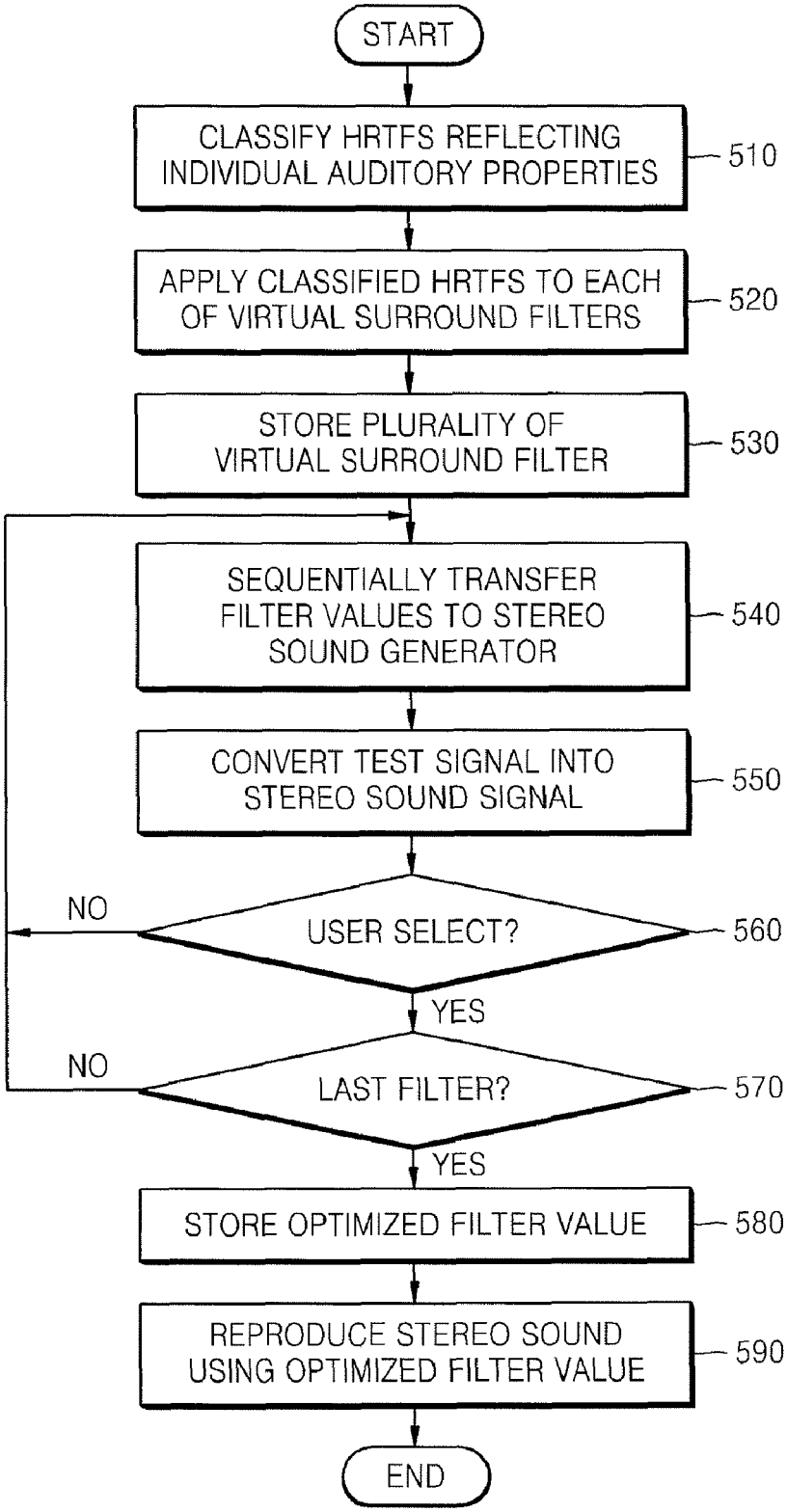
FIG. 5 is a flowchart illustrating a stereo sound reproducing method according to an embodiment of the present general inventive concept.

FIG. 5 is a flowchart illustrating a stereo sound reproducing method according to an embodiment of the present general inventive concept. Referring to FIG. 5, HRTFs are classified into several groups based on individual auditory properties (Operation 510). There are two methods of classifying the HRTFs based on individual auditory properties. First, individual HRTFs are grouped in order to classify the HRTFs. Second, one of the HRTFs is modeled and several representative parameters are selected in order to classify the HRTFs so that several representative HRTFs are determined. The stereo sound reproducing apparatus using the HRTFs reflecting individual auditory properties can increase stereo sound performance compared to a stereo sound reproducing apparatus, for example, using a HRTF measured by a dummy head. In particular, it is important to reflect individual auditory properties in order to localize a virtual sound source in an elevation direction. The sound source in an elevation direction is perceived through the frequency characteristics of an individual pinna. However, since each individual may have a different pinna, for example, in the same manner as each individual has different fingerprints, the HRTF measured by the dummy head makes it difficult to localize the virtual sound source in an elevation direction. Therefore, if a multi-channel such as a 5.1 channel or a 7.1 channel is extended, for example, to a 10.2 channel or a 22.2 channel, since it is important to localize the virtual sound source in an elevation direction. Accordingly, the stereo sound reproducing apparatus needs to reflect individual auditory properties. The elevation direction, for example, represents an angle from a horizontal plane to a projection of a source into the mid-sagittal plane of a head-centered interaural polar coordinate system. In this system the interaural axis is a line passing through the center of the left and right ears of a subject. Also, the origin of this system is the interaural midpoint that is exactly the midpoint of the line adjoining the two ears. This point is usually somewhat below and behind the center of the head.

The classified HRTFs are applied to the filter coefficients of the plurality of virtual surround filters as illustrated in FIG. 3B (Operation 520), respectively. In an embodiment of the present general inventive concept, when the number of the classified HRTFs is N, the number of virtual surround filters is N.

The N virtual surround filters are stored in the filter table storage unit 460 (Operation 530). The N virtual surround filters, for example, are sequentially transferred to the test stereo sound generator 430 (Operation 540).

The test stereo sound generator 430 converts a test signal into a stereo sound signal whenever the N virtual surround filters are applied to the test signal (Operation 550).

A user selects the most appropriate virtual surround filter from the $1^{st}$ virtual surround filter to the $N^{th}$ virtual surround filter (Operations 560 and 570). For example, an index indicating a virtual surround filter used by a stereo sound signal being currently reproduced on an on-screen display (OSD) of a TV is a number. When a virtual sound source is localized at an elevation angle of 45 degrees, the user selects a virtual surround filter capable of localizing the best sound image at an elevation angle of 45 degrees.

If the user selects the most appropriate virtual surround filter, a filter value of the selected virtual surround filter is determined as an individually optimized filter value and stored in the user filter value storage unit 450 (Operation 580).

The individually optimized filter value is transferred to the stereo sound generator 410 to be used in filter units thereof to reproduce an individually optimized stereo sound (Operation 590). The stereo sound generator 410 of FIG. 4 may be the same in the stereo sound reproducing apparatus of FIG. 2.

The present general inventive concept can also be embodied as computer-readable codes on a computer-readable medium. The computer-readable medium can include a computer-readable recording medium and a computer-readable transmission medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through Internet). Also, functional programs, codes and code segments to accomplish the present general inventive concept can be easily construed by programmers skilled in the art to which the present general inventive concept pertains.

As described above, the present general inventive concept can generate an optimal stereo sound in accordance with individual auditory properties. The present general inventive concept can also reproduce a stereo sound using filters designed for various locations of a speaker so that it is not necessary to modify filters for various TV models.

According to various embodiments of the present general inventive concept, a user can feel a strong stereo sound effect regardless of individual auditory properties. When the present general inventive concept is applied to an audio product, the user can also enjoy a DVD encoded with multi-channel audio by using a conventional 2-channel speaker system without an additional speaker.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A stereo sound reproducing method, comprising:

generating one or more virtual surround filters corresponding to one or more HRTFs (head-related transfer functions) classified according to one or more individual auditory properties, generating stereo sound for the one or more virtual surround filters, and selecting at least one from among the one or more virtual surround filters; and reproducing the stereo sound based on a filter value of the selected at least one virtual surround filter, wherein the one or more HRTFs are classified according to the one or more individual auditory properties by selecting one or more representative parameters so as to classify the HRTFs to determine representative HRTFs, and wherein the one or more individual auditory properties are auditory properties including an individual pinna to localize a virtual sound source in an elevation direction of a user.

2. The method of claim 1, wherein the selecting of the at least one from the one or more virtual surround filters comprises:

classifying the HRTFs into a plurality of groups according to the one or more individual auditory properties;

generating the one or more virtual surround filters corresponding to each of the classified HRTF groups;

storing the generated one or more virtual surround filters corresponding to each of the classified HRTF groups;

sequentially transferring the stored one or more virtual surround filters to a stereo sound processor; and reproducing the stereo sound using the one or more virtual surround filters to select at least one from the one or more virtual surround filters.

3. The method of claim 1, wherein the selecting of the at least one from the one or more virtual surround filters comprises:

generating the one or more virtual surround filters corresponding to a plurality of speaker positions; and selecting at least one from the virtual surround filters.

4. The method of claim 2, wherein the user selects one from the one or more virtual surround filters.

5. A stereo sound reproducing apparatus comprising:

an auditory properties correction unit to generate stereo sound for one or more virtual surround filters corresponding to each of a plurality of HRTFs classified according to individual auditory properties and to select at least one from the one or more virtual surround filters; and a stereo sound generator to generate a multi-channel signal as a 2-channel stereo sound based on a filter value of the at least one virtual surround filter selected by the auditory properties correction unit, wherein the plurality of HRTFs are classified according to the individual auditory properties by selecting one or more representative parameters so as to classify the HRTFs to determine representative HRTFs, and wherein the individual auditory properties are auditory properties including an individual pinna to localize a virtual sound source in an elevation direction of a user.

6. The apparatus of claim 5, wherein the auditory properties correction unit comprises:

a test signal generator to generate a test signal;

a test stereo sound generator to generate the one or more virtual surround filters corresponding to each of the HRTFs classified according to the one or more individual auditory properties, and to convert the test signal into a virtual stereo sound based on the one or more virtual surround filters generated by the test stereo sound generator; and a filter selector to select at least one from among the one or more virtual surround filters based on the virtual stereo sound generated by the test stereo sound generator and to establish at least one of the selected virtual surround filter as a user filter.

7. The apparatus of claim 6, further comprising:

a user filter value storage unit to store a filter value of the at least one virtual surround filter selected by the filter selector.

8. The apparatus of claim 5, further comprising:

a filter table storage unit to store filter coefficients of the one or more virtual surround filters generated by the test stereo sound generator.

9. The apparatus of claim 5, wherein the filter selector is used by the user to select the at least one virtual surround filter.

10. The apparatus of claim 5, wherein the stereo sound generator comprises:

a virtual surround filter unit to convert audio signals input according to the filter coefficients reflecting the HRTFs into 2-channel virtual surround audio signals;

a signal correction filter unit correcting one or more signal characteristics between the 2- channel virtual surround audio signals output by the virtual surround filter unit and other channel audio signals than the 2-channel virtual surround audio signals; and an addition unit to add the channel signals output by the virtual surround filter unit and the signal correction filter unit.

11. An apparatus to reproduce stereo sound by which a multi-channel audio signal is reproduced as a 2-channel output, the apparatus comprising:

an auditory properties correction unit to generate one or more virtual surround filters corresponding to each of a plurality of HRTFs classified according to one or more individual auditory properties including an individual pinna to localize a virtual sound source in an elevation direction of a user, generating stereo sound for each of the one or more virtual surround filters, and selecting at least one from the one or more virtual surround filters;

a virtual surround filter unit to convert a 2-channel audio signal into a 2-channel virtual surround audio signal according to the at least one virtual surround filter selected by the auditory properties correction unit;

a signal correction filter unit to correct one or more signal characteristics between the 2-channel virtual surround audio signals output by the virtual surround filter unit and other channel audio signals than the 2-channel virtual surround audio signals; and an addition unit to add the channel signals output by the virtual surround filter unit and the signal correction filter unit, wherein the plurality of HRTFs are classified according to the one or more individual auditory properties by selecting one or more representative parameters so as to classify the HRTFs to determine representative HRTFs.

12. A computer-readable recording medium having embodied thereon a computer program to execute a method, wherein the method comprises:

generating one or more virtual surround filters corresponding to each of a plurality of HRTFs classified according to one or more individual auditory properties including an individual pinna to localize a virtual sound source in an elevation direction of a user, generating stereo sound for each of the one or more virtual surround filters, and selecting at least one from among the one or more virtual surround filters; and reproducing the stereo sound based on a filter value of the selected at least one virtual surround filter, wherein the plurality of HRTFs are classified according to the one or more individual auditory properties by selecting one or more representative parameters so as to classify the HRTFs to determine representative HRTFs.

13. An apparatus to produce stereo sound, the apparatus comprising:

a virtual surround filter unit to receive a first multi-channel audio signal, and to generate plurality of surround signals;

wherein the plurality of surround signals corresponds with one or more individual auditory properties including an individual pinna to localize a virtual sound source in an elevation direction of a user, wherein the one or more individual auditory properties classify one or more representative HRTFs (head related transfer functions) that correspond to the virtual surround filter.

14. The apparatus according to claim 13, further comprising:

a signal correction filter to receive a second multi-channel audio signal and generate a plurality of corrected signals;

a first adder to add one of the plurality of generated corrected signals and one of the plurality of generated surround signals to form a left channel signal; and a second adder to add an other of the plurality of generated corrected signals and an other of the plurality of generated surround signals to form a right channel signal.

15. The apparatus according to claim 14, wherein the virtual surround filter unit comprises:

one or more binaural synthesis filter units;

one or more cross-talk canceling filter units; and one or more addition units.

16. A method of reproducing stereo sound, the method comprising:

generating a plurality of surround signals from a first multi-channel audio signal corresponding to one or more individual auditory properties including an individual pinna to localize a virtual sound source in an elevation direction of a user;

generating a plurality of corrected signals from a second multi-channel audio signal;

adding one of the plurality of surround signals and one of the plurality of corrected signals to form a left channel signal; and adding an other of the plurality of surround signals and an other of the plurality of corrected signals to form a right channel signal, wherein the one or more individual auditory properties classify one or more representative HRTFs (head related transfer functions) to generate the plurality of surround signals.

17. A stereo sound reproducing apparatus, comprising:

an auditory properties correction unit to select at least one virtual surround filter corresponding to one or more individual auditory characteristics including an individual pinna to localize a virtual sound source in an elevation direction of a user; and a stereo sound generator to generate a two-channel stereo sound based on a filter value of the at least one virtual surround filter selected by the auditory properties correction unit, wherein the one or more individual auditory properties classify one or more representative HRTFs (head related transfer functions) that correspond with the selected at least one virtual surround filter.

18. A stereo sound reproducing system, comprising:

an auditory properties correction unit to localize a virtual signal source in an elevated direction based on one or more individual auditory properties including an individual pinna to localize a virtual sound source in an elevation direction of a user; and a stereo sound generator to generate a multi-channel stereo sound in response to the auditory properties correction unit, wherein the one or more individual auditory properties classify one or more representative HRTFs (head related transfer functions) to localize the virtual signal source in an elevated direction.

19. A stereo sound reproducing apparatus to process a multi-channel audio signal, the apparatus comprising:

a signal correction filter unit to process a first group of channels of the multi-channel audio signal to generate a first signal and a second signal;

a virtual surround filter unit to process a second group of channels of the multi-channel audio signal according to one or more virtual surround filters corresponding to one or more HRTFs and one or more individual auditory properties including an individual pinna to localize a virtual sound source in an elevation direction of a user, to generate a first surround signal and a second surround signal; and an addition unit to add the first signal and the first surround signal to generate a first speaker signal, and to add the second signal and the second surround signal to generate a second speaker signal, wherein the one or more HRTFs are classified according to the one or more individual auditory properties by selecting one or more representative parameters so as to classify the HRTFs to determine representative HRTFs.

20. The apparatus of claim 19, further comprising:

an auditory properties correction unit to change the one or more virtual surround filters.

21. A stereo sound reproducing apparatus to process a multi-channel audio signal, the apparatus comprising:

a stereo sound generator having one or more filter units to process surround channels according to one or more filter coefficients corresponding to at least one of individual auditory properties to generate first and second surround signals, wherein the at least one individual auditory properties classify one or more representative HRTFs (head related transfer functions) to generate the first and second surround signals, and wherein the individual auditory properties are auditory properties including an individual pinna to localize a virtual sound source in an elevation direction of a user.

22. The apparatus of claims 21, further comprising:

an auditory properties correction unit to change the one or more filter coefficients of the one or more filter units according to a selection of the individual auditory properties.

23. A method of filtering stereo sound, the method comprising:

classifying one or more HRTFs (head-related transfer functions) according to one or more individual auditory properties including an individual pinna to localize a virtual sound source in an elevation direction of a user;

generating one or more virtual surround filters corresponding to the classified one or more HTRFs; and receiving a selection of one of the one or more generated virtual surround filters to filter the stereo sound to be reproduced, wherein the one or more HRTFs are classified according to the one or more individual auditory properties by selecting one or more representative parameters so as to classify the HRTFs to determine representative HRTFs.

* * * * *